United States Patent [19]

Vecchia

[11] Patent Number: 4,865,616

[45] Date of Patent: Sep. 12, 1989

[54] PROCESS AND PLANT TO CARBONIZE VEGETABLE IMPURITIES IN TEXTILE WOOLEN MANUFACTURED ARTICLES

[75] Inventor: Gino D. Vecchia, Santorso, Italy

[73] Assignee: Sperotto-Rimar S.p.A., Zane, Italy

[21] Appl. No.: 105,882

[22] Filed: Oct. 7, 1987

[30] Foreign Application Priority Data

Oct. 31, 1986 [IT] Italy ..... 22200 A/86

[51] Int. Cl.[4] ..... D06M 1/00; D06M 13/00

[52] U.S. Cl. ..... 8/128.1; 8/139.1

[58] Field of Search ..... 8/139.1, 128.1, 140

[56] References Cited

U.S. PATENT DOCUMENTS

| | | | |
|---|---|---|---|
| 698,207 | 4/1902 | Maertens | 8/139.1 |
| 4,082,508 | 4/1978 | Marshall | 8/139.1 |

*Primary Examiner*—Paul Lieberman
*Assistant Examiner*—John F. McNally
*Attorney, Agent, or Firm*—Roberts, Spiecens & Cohen

[57] ABSTRACT

A process and plant to carbonize vegetable impurities in woolen manufactured articles, which makes possible a better and uniform removal of the impurities to be obtained, with a considerable reduction in cost, at the same time avoiding wash water waste and environmental atmospheric pollution, by means of a reduced number of treatment steps.

8 Claims, 1 Drawing Sheet

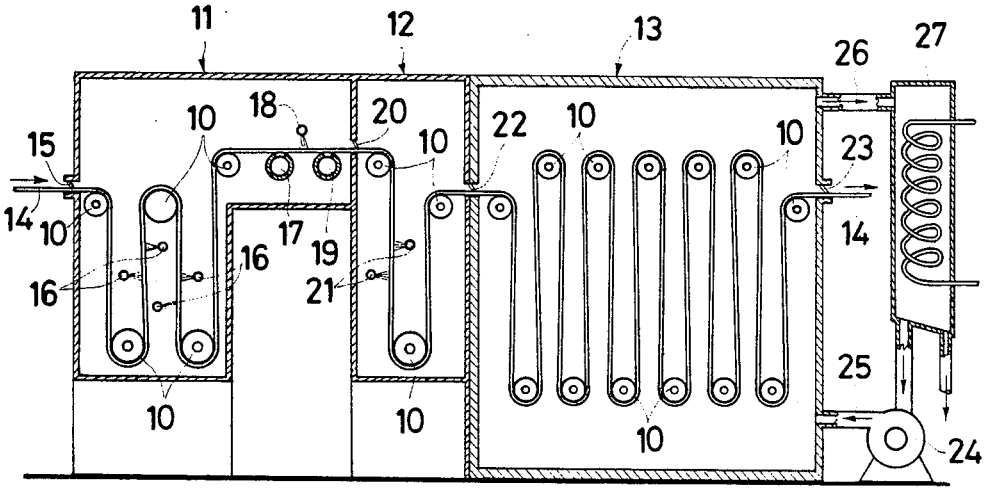
11
12
13
26
27
15
10
18
20
10
22
10
10
23
14
10
17
19
14
16
16
21
25
10
10
10
24

PROCESS AND PLANT TO CARBONIZE VEGETABLE IMPURITIES IN TEXTILE WOOLEN MANUFACTURED ARTICLES

FIELD OF THE INVENTION

The present invention relates to a process and plant to carbonize the vegetable impurities contained in woolen textile manufactured articles.

It is known to carry out a process of carbonization of woolen cloth, in order to remove existing vegetable impurities.

The process of carbonization of the woolen cloth is traditionally carried out on facilities which provide, in sequence, an operation of impregnation of the cloth to be carbonized with an aqueous solution of sulphuric acid, followed by a squeezing operation, and a step or thermal treatment of the same cloth, inside a ventilated chamber with open-loop air circulation, during which the cloth is dried due to water evaporation, and the vegetable impurities are carbonized due to the combined effect of temperature, and of the acid absorbed by the fibre.

The so treated cloth contains therefore a relatively high amount of residual acid, which has to be reduced. For that purpose, the carbonized cloth is usually submitted to a step of intense washing with water, which generally takes place in a separate facility. In particular, then, in the frequently occurring case of carbonization of the grey cloth from weaving, a further function performed by said washing step is that of cleaning the cloth, i.e., removing the lubricating substances of greasy and oily nature, which were previously deposited on the fibre during the course of the preceding spinning and weaving processing steps.

It is in fact customary, due to prevailing economic reasons, not to submit the cloth to be carbonized to a preliminary washing step to remove such lubricating substances, in that carrying out such operation once only, after the carbonization process, is preferred, so to obtain, at the same time, cleaning and removal of the residual acid remaining in the cloth.

Such an operating procedure suffers from the following drawbacks:

the lubricating substances on the cloth to be carbonized, if not removed, hinder the aggressive action of the acid on the vegetable impurities, resulting in an impairment of the quality of carbonization;

during the thermal treatment step of the carbonization process, the low-boiling oils present on the cloth tend to sublime due to the effect of temperature, and are therefore expelled to the outside, with the air, through exhausting chimneys, creating not negligible problems of atmospheric pollution;

the step of cloth washing after the true carbonization requires the consumption of large amounts of water, and produces a corresponding large amount of polluting acid waste liquid, whose economic and environmental consequences constitute the most considerable and important among all problems.

SUMMARY OF THE INVENTION

The process of carbonization of woolen cloth of the present invention is that of overcoming the negative aspects typical of the traditional carbonization process, while at the same time supplying a full set of advantages of qualitative, economic and environmental character.

Such object is achieved according to the present invention by providing a process for carbonizing the vegetable impurities present in woolen textile manufactured articles, wherein the following operations are provided:

treatment of the textile article with chlorinated solvent, until a first deep impregnation thereof is obtained;

treatment of the textile article impregnated with said chlorinated solvent, with an aqueous solution of sulphuric acid, until a second, surface, impregnation is obtained, and thermal treatment until the evaporation of the chlorinated solvent and of water, and the true carbonization of said vegetable impurities are obtained.

Said chlorinated solvent of the process of the invention is preferably perchloroethylene.

According to a preferred embodiment, a plant for carrying out the carbonization according to the process of the present invention comprises a first chamber for treatment with chlorinated solvent, a second chamber of treatment with an aqueous solution for sulphuric acid, and a third chamber for drying and true carbonization.

BRIEF DESCRIPTION OF THE DRAWING

The characteristics and advantages of a process according to the present invention will become clearer from the following disclosure, given by way of example and without limitation, with reference to the hereto attached sole figure of the drawing which diagrammatically illustrates an embodiment according to the invention.

DETAILED DESCRIPTION OF PREFERRED EMBODIMENTS

A woolen textile article or cloth, once produced, must undergo a process of carbonization, for the purpose of removing the vegetable impurities which are present in it.

According to the present invention, for such a purpose, the woolen cloth undergoes a first operation of treatment with chlorinated solvent, until a first deep impregnation of the cloth is obtained.

The purpose of this first treatment step—in particular in case of carbonization of grey cloth from weaving—is to remove the lubricating substances of greasy and oily character deposited on the fibre during spinning and weaving. In fact, the cleaning of the cloth makes it possible for the vegetable impurities to be more easily attacked by the acid during the following step of true carbonization. However, independently of any cleansing function, the operation of impregnation of the cloth with the solvent is basic and essential for the purposes of the application of the process according to the invention.

In particular and preferably, during this first impregnation or treatment step, as the chlorinated solvent, perchloroethylene is used, and said impregnation, which occurs deeply in the fibre, is carried out by means of a simple washing of the cloth.

Thereafter, the cloth, moist from chlorinated solvent, undergoes a second treatment step, and is impregnated with an aqueous solution of sulphuric acid.

It is known, in fact, that the chlorinated solvents, and in particular perchloroethylene, thanks to their low surface tension are able to rapidly and deeply soak the textile fibres, much more than the aqueous solution. It follows therefrom that if a cloth impregnated with the solvent is subsequently treated with an aqueous solution, this latter does not have the capability to displace the solvent from the fibre, and to replace it, but to a minimum extent, and on the surface only. In other words, the presence of the solvent in the cloth at the time of the second impregnation with the aqueous solution of sulphuric acid, constitutes a protecting element against the penetration of acid into the interior of the fibre. On the other hand, the vegetable impurities contained in the cloth, which are strongly hydrophilic, and on which the solvent is distributed on the surface only, preferentially absorb the aqueous solution of sulphuric acid. In practice, by operating in that way, a selective absorption is accomplished of the aqueous solution of sulphuric acid in the vegetable impurities to be carbonized, the absorption of the acid by the fibre being considerably reduced, as compared to what occurs in the traditional carbonization process.

Finally, the cloth, impregnated with the resulting mixture of chlorinated solvent and aqueous solution of sulphuric acid, is subjected to a step of thermal treatment, during which both solvent and water are evaporated from the cloth, and the vegetable impurities undergo true carbonization due to the combined effect of temperature, and of residual sulphuric acid.

According to a non-limitative example, a plant shown in the hereto attached figure, and embodying the process according to the invention, is essentially constituted by a first chamber or unit of treatment with the chlorinated solvent 11, a second chamber of treatment with the aqueous solution of sulphuric acid 12, and a third chamber of thermal treatment 13 for drying, and the true carbonization. A woolen cloth 14 to be carbonized is continuously fed on a set of rollers 10, through an opening provided with seal elements 15, into the first processing chamber 11, wherein it is subjected to a plurality of sprayings, by means of a set of nozzles 16, with chlorinated solvent. The solvent is then exhausted by a first means 17, or intaking-lip tube, which has the purpose of removing from the woolen cloth 14 most of the solvent applied by nozzles 16.

The woolen cloth 14 is then rinsed by means of a further solvent spray, delivered through a nozzle 18, and is subsequently subjected to the sucking action of a further means 19, or intaking-lip tube, so that on said cloth 14 a determined amount of chlorinated solvent remains.

The woolen cloth 14, moist with solvent, subsequently travels on a further set of rollers 10, and enters, through an opening provided with seal elements 20, the second processing chamber 12, in which a desired and predetermined amount of aqueous solution of sulphuric acid is applied by means of nozzles 21.

The woolen cloth 14, thus impregnated by the resulting mixture of chlorinated solvent and of acidic aqueous solution, passes through a further opening provided with seal elements 22, and enters third chamber 13 where the cloth travels, slidingly guided on a further set of rollers 10, the third chamber 13 being, i.e., the thermal treatment chamber.

Inside third chamber 13, the drying and the true carbonization of the cloth take place, by means of the evaporation of the above-said mixture, and the carbonization of the vegetable impurities due to the combined effect both of temperature, and of the residual sulphuric acid.

Finally, the woolen cloth 14, passing through a last opening provided with seal elements 23, is extracted in a dry and carbonized state from the third chamber 13.

Preferably, inside said third chamber 13 a means is provided, to accomplish a closed-loop circulation of hot air, e.g., by a thermo-fan 24, which is provided with a delivery duct 25 and an intake duct 26, both connected chamber 13.

Inside the air circuit, a refrigerator 27 is provided, which performs the function of de-saturating the recycled air, maintaining it at a constant saturation level, and of simultaneously recovering the solvent and water evaporated from the cloth, which can be sent to a separation tank (not shown in figure).

The impregnation of the woolen cloth 14 with the aqueous solution of sulphuric acid inside the second chamber 12 can be also accomplished by means different from those illustrated, e.g., by spreading by means of plating rollers, or by direct dipping of the fed cloth. In case the direct dipping into a bath of acidic aqueous solution is used, the cloth should be subsequently squeezed by squeezing rollers.

In any case, whatever the means of application of said aqueous solution is, an application must be made possible of a pre-determined and controlled amount of the aqueous solution, so to prepare the damp cloth in such a way as to optimize the true carbonization.

In a similar way, the chamber for treatment with the chlorinated solvent 11 and the thermal-treatment chamber 13 can be modified to account for particular specific requirements within the scope of the method of the present invention.

Summing-up, the process of carbonization and the relevant exemplifying plant according to the present invention, as compared to those presently used in industry, offer a full set of considerable advantages.

First of all, a more uniform and efficient carbonization of the vegetable impurities is obtained, thanks to the preliminary cleaning of the cloth by means of the treatment with chlorinated solvent, which removes the lubricating substances of greasy and oily character.

Then, the elimination is obtained of the phenomena of sublimation of the low-boiling oils during the end thermal treatment of the cloth, and of the related problems of atmospheric pollution, in as much as the thermal treatment chamber is of the type with closed-loop air circulation, and is therefore free from exhausting chimneys leading to the outside.

The limited absorption of acidic aqueous solution on the fabric, due to the protective action performed by the chlorinated solvent, leads consequently to a considerable reduction in the consumption of the processing acid.

Finally, the residual content of acid in the carbonized cloth is so small, as not to require any further steps of washing and removal of the acid from the cloth. This involves, besides the elimination of an additional step, a large water saving, and eliminates the related discharge of aciding polluting effluents.

What is claimed:

1. A process of carbonizing vegetable impurities present in woolen textile manufactured articles, comprising: treating the textile article with chlorinated hydrocarbon solvent, to remove lubricating substances present in the article and to obtain a deep impregnation of the fibers of the article with said chlorinated solvent; treating the textile article thus impregnated with said chlorinated solvent, with an aqueous solution of sulfuric acid, to obtain a surface impregnation of the fiber of the article with said sulfuric acid solution, and effecting thermal treatment of the article to evaporate the chlorinated solvent and water therefrom, and obtain true carbonization of said vegetable impurities.

2. Carbonization process according to claim 1, wherein the chlorinated solvent is perchloroethylene.

3. Carbonization process according to claim 1, wherein said treatment with chlorinated solvent is carried out by successive spraying and suction steps.

4. Carbonization process according to claim 1, wherein said treatment with an aqueous solution of sulphuric acid is carried out by spraying.

5. Carbonization process according to claim 1, wherein said thermal treatment is carried out by circulating hot air in a closed loop.

6. Carbonization process according to claim 5 comprising cooling the circulated hot air in said closed loop and discharging condensed solvent and water from cooled circulated hot air from said loop.

7. A method according to claim 5 comprising removing solvent and water extracted from the article which are present in the circulated air.

8. A method as claimed in claim 1 wherein said vegetable impurities in the article are hydrophilic and absorb the aqueous solution of sulphuric acid.

* * * * *